US005746071A

United States Patent [19]

Youn

[11] Patent Number: 5,746,071

[45] Date of Patent: May 5, 1998

[54] WASHING MACHINE HAVING A WASHING LIQUID PUMPING APPARATUS

[75] Inventor: Gab-Jin Youn, Kwangju, Rep. of Korea

[73] Assignee: Daewoo Electronics Co., Ltd., Seoul, Rep. of Korea

[21] Appl. No.: 774,074

[22] Filed: Dec. 23, 1996

[30] Foreign Application Priority Data

Dec. 28, 1995 [KR] Rep. of Korea ..... 1995 50766

[51] Int. Cl.[6] ..... D06F 17/02; D06F 17/06

[52] U.S. Cl. ..... 68/53; 68/133; 68/184

[58] Field of Search ..... 68/23.6, 23.7, 68/53, 133, 184

[56] References Cited

U.S. PATENT DOCUMENTS

| | | | |
|---|---|---|---|
| 4,402,198 | 9/1983 | Cartier | 68/53 X |
| 4,420,952 | 12/1983 | Brenner et al. | 68/53 |

FOREIGN PATENT DOCUMENTS

| | | | |
|---|---|---|---|
| 844589 | 7/1952 | Germany | 68/53 |
| 482041 | 6/1953 | Italy | 68/184 |
| 2 292 565 | 2/1996 | United Kingdom . | |

*Primary Examiner*—Philip R. Coe

[57] ABSTRACT

Disclosed is a washing machine which can strongly pump a washing liquid towards an upper portion of a spin tub while a washing cycle is being executed. The washing machine has a housing and an outer tub disposed in the housing so as to receive the washing liquid. A spin tub accommodated in the outer tub is divided into an upper chamber and a lower chamber by a compartment, and is formed at an inner wall thereof with first and second cylinders which are positioned in opposition to each other. The washing machine has a motor for generating a rotational force, a pulsator mounted on an upper surface of the compartment, and a pulsator driving section for driving the pulsator by receiving the rotational force from the motor. First and second piston assemblies are respectively disposed within the first and second cylinders in order to pump the washing liquid towards an upper portion of the spin tub. First and second power transferring mechanisms for respectively transferring the rotational force of the motor to the first and second piston assemblies are provided in the lower chamber of the spin tub. The washing machine strongly pumps the washing liquid towards the upper portion of the spin tub while the washing cycle is being executed, so a turbulent liquid flow is created in the spin tub and thereby, the articles are prevented from tangling with each other. The washing liquid pumped towards the upper portion of the spin tub collides with articles floating in the upper portion of the spin tub, thereby improving the washing effect at the upper portion of the spin tub.

15 Claims, 5 Drawing Sheets

WASHING MACHINE HAVING A WASHING LIQUID PUMPING APPARATUS

BACKGROUND OF THE INVENTION

1. Field of the Invention

The present invention relates to a washing machine, and more particularly to a washing machine having a piston assembly for pumping a washing liquid towards an upper portion of a spin tub while a washing cycle is being executed.

2. Prior Arts

Generally, a washing machine is an appliance for separating dirt from articles to be washed such as clothing by sequentially carrying out various cycles in the order of liquid feeding, washing, rinsing, dehydrating, and draining cycles.

While the above cycles are being executed, dirt contained in the articles separates from the articles by means of detergents or by means of friction between the washing liquid and the articles.

However, in conventional washing machines, concentric swirl-shaped liquid flows are generated in a spin tub, so the articles flowing along the concentric swirl-shaped liquid flows become tangled with each other. In addition, the swirl-shaped liquid flows generated from a bottom of the spin tub become weak as they reach an upper portion of the spin tub due to an interference by the articles. For this reason, the washing effect at the upper portion of the spin tub is reduced.

In order to solve the above problem, another conventional washing machines which pump a washing liquid toward an upper portion of a spin tub while a washing cycle is being executed, thereby preventing the articles from tangling and improving the washing effect, are suggested. U.S. Pat. No. 4,402,198 issued to Cartier discloses one such washing machine.

FIGS. 4 and 5 show Cartier's washing machine.

As shown in FIG. 4, Cartier's washing machine 10 includes a cabinet 12. Cabinet 12 has a top 14 with a lid 16 and a console 18 having presettable controls 20 thereon. Lid 16 in top 14 of cabinet 12 permits access into an outer tub 22. Enclosed and supported within outer tub 22 is a spin tub 24 in which an agitator 25 is mounted.

Below outer tub 22, but within cabinet 12, there is provided an electric motor 28 which oscillatably drives agitator 26 through a transmission 30.

FIG. 5 is a sectional view showing an internal structure of agitator 26. As shown in FIG. 5, agitator 26 has a skirt portion 32 near the bottom thereof and a substantially vertical barrel portion 34 integrally connected with skirt portion 32 and projecting upwardly therefrom. A plurality of vanes 36 are provided around a periphery of barrel 34. Vanes 36 extend downwardly and outwardly along skirt portion 32 of agitator 26.

Agitator 26 is of a two-wall construction having an outer wall 40 and a radially inwardly spaced inner wall 41. An annular space 46 is formed between outer wall 40 and inner wall 41. In addition, a channel 42, into which the washing liquid is introduced when agitator 26 rotates, is formed in skirt portion 32.

A chamber 58 is formed at an upper portion of barrel portion 34. A filtering means 60 is detachably secured within chamber 58. Chamber 58 communicates with annular space 46 by an opening 72. In addition, a plurality of apertures 76 are provided at a terminal end of vertical barrel 34.

In a washing cycle, when a user pushes controls 20 installed on console table 18, a microcomputer (not shown) accommodated in washing machine 10 sends an operating signal to electric motor 28 so that electric motor 28 rotates. The rotational force of electric motor 28 is transferred to agitator 26 through transmission 30, so agitator 26 rotates.

As agitator 26 rotates, the washing liquid is introduced through channel 42 formed in skirt portion 32 into annular space 46 formed between outer wall 30 and inner wall 41.

As agitator 26 continues to rotate, the washing liquid flows into chamber 58 through opening 72. Then, the washing liquid which has flowed into chamber 58 passes through filtering means 60 and pumps towards the upper portion of outer tub 22 through apertures 76 formed at the distal end of vertical barrel 34.

In this manner, Cartier's washing machine 10 pumps the washing liquid towards the upper portion of outer tub 22, so a turbulent liquid flow is generated in outer tub 22 and thereby, the washing effect is improved.

However, Cartier's washing machine 10 has the following disadvantages.

Firstly, agitator 26 has a complicated structure, so the manufacturing of agitator 26 is very difficult.

Further, since the washing liquid pumps towards the upper portion of outer tub 22 through relatively small apertures 76, the washing liquid which has been pumped towards the upper portion of outer tub 22 does not strongly collide with the articles. For this reason, the washing efficiency at the upper portion of outer tub 22 is relatively reduced.

SUMMARY OF THE INVENTION

The present invention has been made to overcome the above described problems of the prior arts, and accordingly it is an object of the present invention to provide a washing machine which can strongly pump the washing liquid towards an upper portion of a spin tub or an outer tub, thereby generating a turbulent liquid flow in a spin tub, and thereby improving the washing efficiency.

To achieve the above object, the present invention provides a washing machine comprising:

a housing;

an outer tub disposed in the housing so as to receive a washing liquid;

a spin tub accommodated in the outer tub, the spin tub having a plurality of discharging holes at a side wall thereof, the spin tub being divided into an upper chamber and a lower chamber by a compartment, the spin tub being formed at an inner wall thereof with first and second cylinders which are positioned in opposition to each other;

a motor for generating a rotational force;

a pulsator mounted on an upper surface of the compartment;

a pulsator driving section for driving the pulsator by receiving the rotational force from the motor;

a first means for pumping the washing liquid towards an upper portion of the spin tub, the first means being disposed within the first cylinder;

a second means for pumping the washing liquid towards the upper portion of the spin tub, the second means being disposed within the second cylinder;

a third means for transferring the rotational force of the motor to the first means; and a fourth means for transferring the rotational force of the motor to the second means.

According to a preferred embodiment of the present invention, the motor includes a reversible motor. The first and second cylinders are respectively formed at upper walls thereof with first and second apertures, so that the washing liquid is pumped towards the upper portion of the spin tub.

The pulsator driving section includes a transmission connected to the motor, a first pulsator rotating shaft mounted on an upper portion of the transmission, a bevel gear assembly, and a second pulsator rotating shaft. The bevel gear assembly has first, second, third, and fourth bevel gears. The first bevel gear is engaged with both second and fourth bevel gears, the second bevel gear is engaged with both first and third bevel gears, the third bevel gear is engaged with both second and fourth bevel gears, and the fourth bevel gear is engaged with both third and first bevel gears. The first pulsator rotating shaft is fixedly coupled to the first bevel gear. A first end of the second pulsator driving shaft is fixedly coupled to the pulsator, and a second end of the second pulsator driving shaft is fixedly coupled to the third bevel gear.

The first means includes a first piston assembly having a first piston head slidably disposed in the first cylinder, and includes a first actuating rod integrally formed with the first piston head. The second means includes a second piston assembly having a second piston head slidably disposed in the second cylinder and a second actuating rod integrally formed with the second piston head.

The first and second cylinders are respectively provided at undersides thereof with first and second guiders for guiding a reciprocating movement of the first and second piston assemblies.

The third means includes a first connecting rod having a first end fixedly coupled to the second bevel gear, includes a first support member for rotatably supporting the first connecting rod, and includes a first eccentric rotating plate provided on a first predetermined position of the first connecting rod. A center of the first eccentric rotating plate is off-set from a center of the first connecting rod by a predetermined distance.

The fourth means includes a second connecting rod having a first end fixedly coupled to the fourth bevel gear, includes a second support member for rotatably supporting the second connecting rod, and includes a second eccentric rotating plate provided on a second predetermined position of the second connecting rod. A center of the second eccentric rotating plate is off-set from a center of the second connecting rod by a predetermined distance.

A second end of the first connecting rod is rotatably inserted into a first engagement hole formed at a lower inner wall of the spin tub, and a second end of the second connecting rod is rotatably inserted into a second engagement hole which is formed in opposition to the first engagement hole.

The first eccentric rotating plate is formed at a circumference thereof with a first annular groove into which the first piston assembly is slidably inserted, and the second eccentric rotating plate is formed at a circumference thereof with a second annular groove into which the second piston assembly is slidably inserted.

The washing machine having the construction as described above operates as follows.

Firstly, when a user pushes an operating button installed on a control panel, the washing liquid is introduced from a liquid source into the outer tub.

When the liquid level in the outer tub reaches a predetermined liquid level, the supply of the washing liquid stops and the motor rotates in the forward and reverse directions. The rotational force of the motor is transmitted to the pulsator so that the washing cycle is executed.

At the same time, the rotational force of the motor is also transmitted to both first and second power transferring mechanisms, so first and second connecting rods rotate in directions opposite to each other.

As first and second connecting rods rotate, first and second eccentric rotating plates also rotate, so first and second piston assemblies, which are slidably inserted into first and second annular grooves, are reciprocated within first and second cylinders, respectively.

By the reciprocating movement of first and second piston assemblies, the washing liquid filled in first and second cylinders is pumped towards the upper portion of the spin tub.

As described above, the washing machine of the present invention can strongly pump the washing liquid toward the upper portion of the spin tub while the washing cycle is being executed, so a turbulent liquid flow is created in the spin tub and thereby, the articles are prevented from tangling with each other.

In addition, the washing liquid which has been pumped towards the upper portion of the spin tub collides with articles floating in the upper portion of the spin tub, thereby improving the washing effect at the upper portion of the spin tub.

BRIEF DESCRIPTION OF THE DRAWINGS

The above objects and other advantages of the present invention will become more apparent by describing in detail a preferred embodiment with reference to the attached drawings, in which.

DESCRIPTION OF THE PREFERRED EMBODIMENTS

Hereinafter, a preferred embodiment of the present invention will be described in detail with reference to the accompanying drawings.

Figure 1:
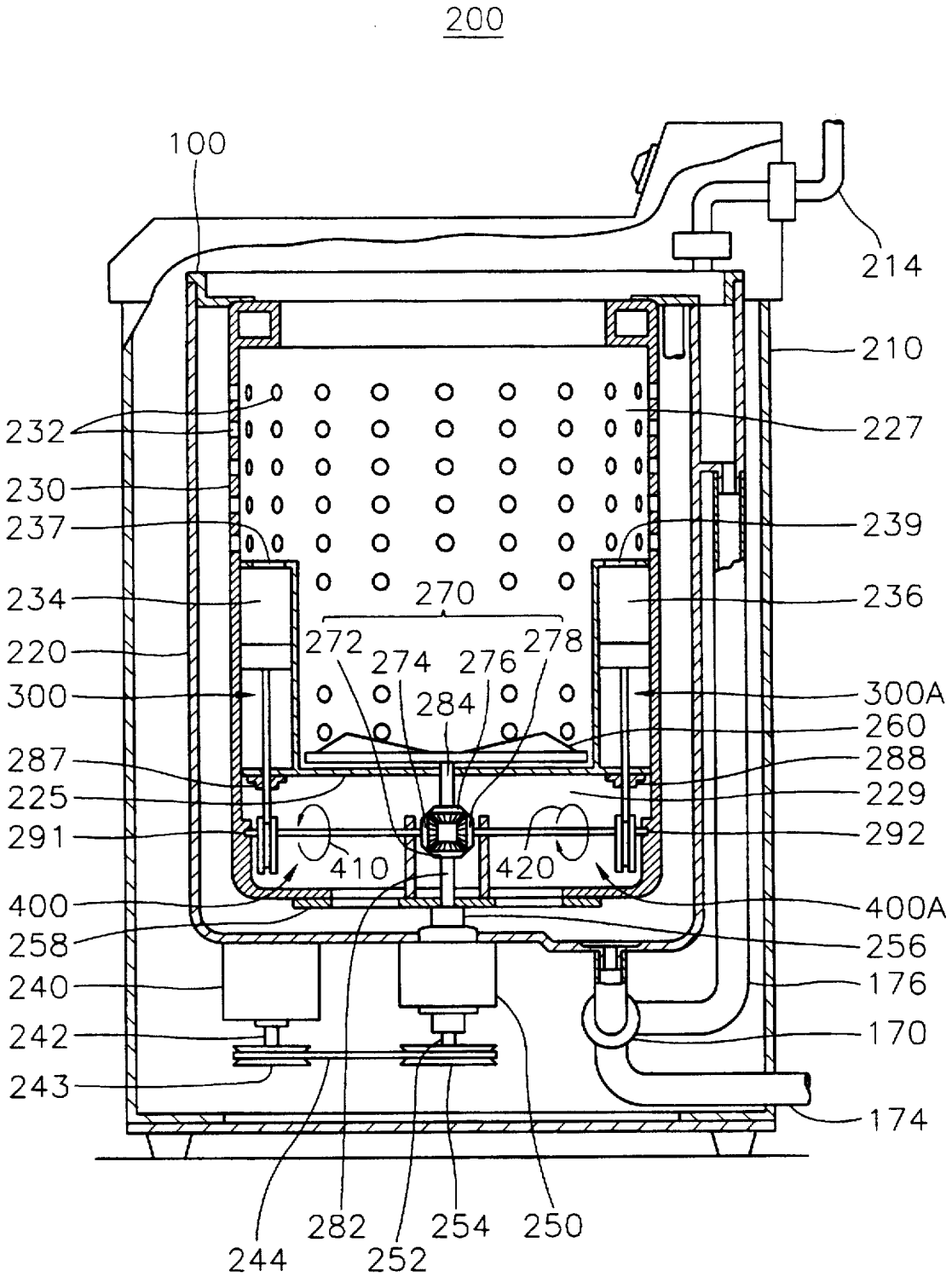
FIG. 1 is a sectional view showing the structure of a washing machine according to one embodiment of the present invention.

FIG. 1 shows a washing machine 200 according to one embodiment of the present invention.

As shown in FIG. 1, washing machine 200 has a housing 210. An outer tub 220 is disposed in housing 210 so as to receive a washing liquid, and a spin tub 230 is accommodated in outer tub 220. Spin tub 230 is formed at its side wall with a plurality of discharging holes 232.

Disposed below outer tub 220 are a motor 240, which generates a rotational force for operating washing machine 200, and a transmission 250, which receives the rotational force from motor 240 and then transmits the rotational force to spin tub 230 or to a pulsator 260. According to a preferred embodiment of the present invention, motor 240 includes a reversible motor.

When a washing cycle is being executed, transmission 250 transmits the rotational force of motor 240 to pulsator 260 through a first pulsator rotating shaft 282, through a bevel gear assembly 270, and through a second pulsator rotating shaft 284. In addition, when a dehydrating cycle is being executed, transmission 250 transmits the rotational force of motor 240 to spin tub 230 through a connection member 256 and through rotating plate 258 fixedly coupled to an underside of spin tub 230.

Spin tub 230 is divided into an upper chamber 227 and a lower chamber 229 by a compartment 225. Pulsator 260 for generating a liquid flow is rotatably mounted on an upper surface of compartment 225. A first cylinder 234 and a second cylinder 236, which are disposed in opposition to each other, are provided at the inner wall of upper chamber 227 of spin tub 230. First and second cylinders 234 and 236 are respectively formed at upper walls thereof with first and second apertures 237 and 239 through which the washing liquid is pumped towards the upper portion of spin tub 230.

In addition, first and second piston assemblies 300 and 300A are slidably accommodated in first and second cylinders 234 and 236, respectively. First and second guiders 287 and 288 for guiding the reciprocating movement of first and second piston assemblies 300 and 300A are respectively secured to undersides of first and second cylinders 234 and 236. According to a preferred embodiment of the present invention, first and second guiders 287 and 288 are integrally formed at the undersides of first and second cylinders 234 and 236, respectively.

Provided in lower chamber 229 of spin tub 230 are first and second power transferring mechanisms 400 and 400A for transferring the rotational force of motor 240 to first and second piston assemblies 300 and 300A, respectively. In order to rotatably support first and second power transferring mechanisms 400 and 400A, first and second engagement holes 291 and 292, into which first and second power transferring mechanisms 400 and 400A are rotatably inserted, are formed at the inner lower wall of lower chamber 229. First and second piston assemblies 300 and 300A, and first and second power transferring mechanisms 400 and 400A will be further explained below with reference to FIG. 2.

A spraying nozzle assembly 100, which sprays the circulated washing liquid into spin tub 230, is mounted on the upper portion of outer tub 220. In addition, a circulation pump 170 is disposed at a lower portion of housing 210. Circulation pump 170 is communicated with outer tub 220 so as to circulate the washing liquid into spraying nozzle assembly 100 or so as to drain the washing liquid through a drain tube 174 out of washing machine 200.

Motor 240 has a motor shaft 242 which is formed at its lower end with a first pulley 243. Transmission 250 has a rotating shaft 252 which is formed at its lower end with a second pulley 254. Second pulley 254 is connected to first pulley 243 by a belt 244 in such a manner that the rotational force of motor 240 can be transmitted to transmission 250.

In addition, circulation pump 170 has a pump motor (not shown) therein and is connected to outer tub 220 through a discharging tube 172 so as to receive the washing liquid from outer tub 220. Circulation pump 170 is also connected to spraying nozzle assembly 100 through a circulation tube 176 so that the circulated washing liquid is sprayed into spin tub 230.

Figure 2:
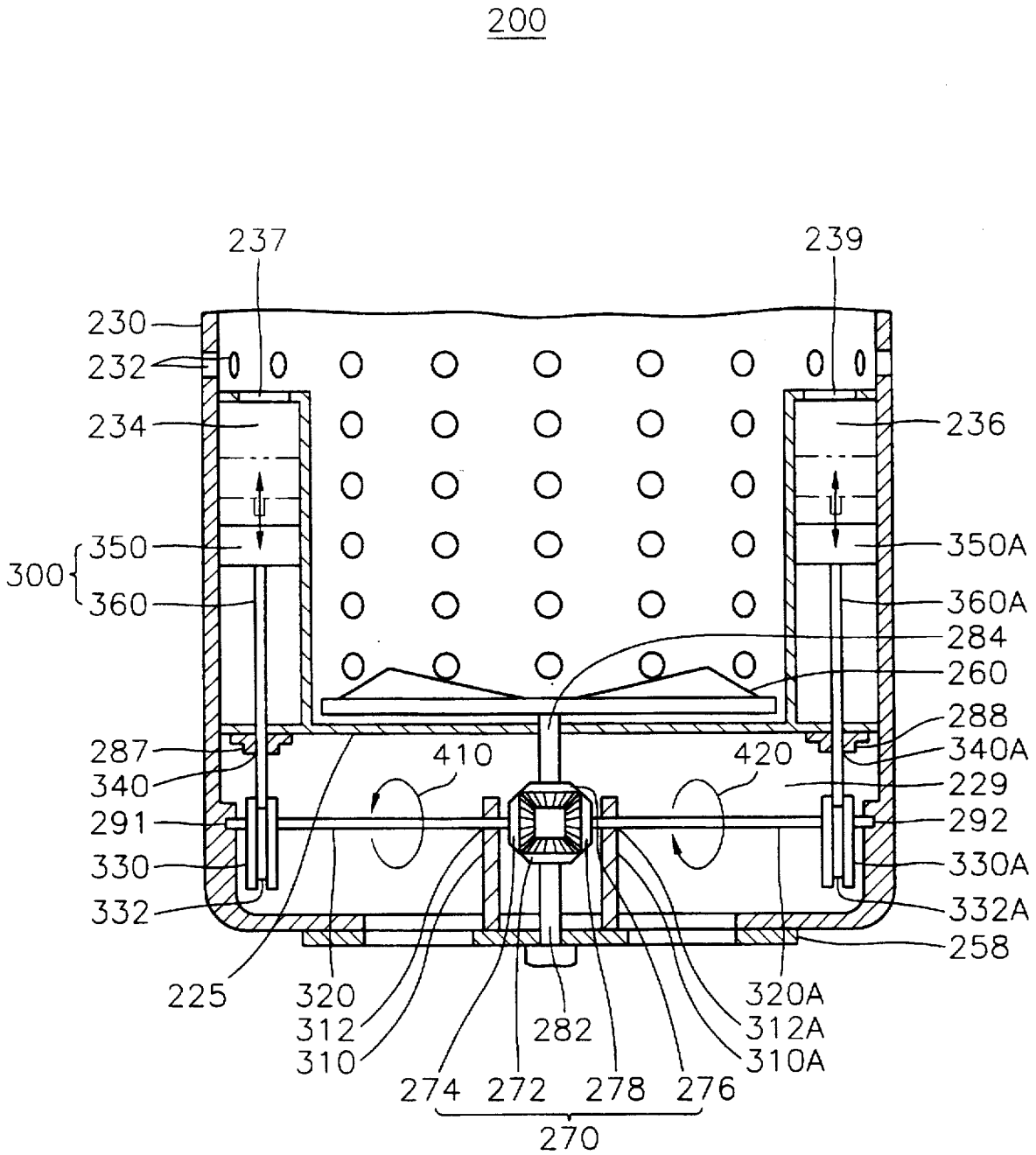
FIG. 2 is an enlarged view of piston assemblies and power transferring mechanisms coupled to the piston assemblies shown in FIG. 1.

Referring to FIG. 2, bevel gear assembly 270 includes first to fourth bevel gears 272, 274, 276, and 278. First bevel gear 272 is engaged with both second bevel gear 274 and fourth bevel gear 278, second bevel gear 274 is engaged with both first bevel gear 272 and third bevel gear 276, third bevel gear 276 is engaged with both second bevel gear 274 and fourth bevel gear 278, and fourth bevel gear 278 is engaged with both third bevel gear 276 and first bevel gear 272. First pulsator rotating shaft 282 is fixedly coupled to first bevel gear 272 of bevel gear assembly 270. First pulsator rotating shaft 282 transmits the rotational force of motor 240 to first bevel gear 272, so that second to fourth bevel gears 274, 276 and 278 successively rotate.

One end of second pulsator rotating shaft 284 is fixedly coupled to third bevel gear 276 and the other end of second pulsator rotating shaft 284 is fixedly coupled to a center portion of pulsator 260. Accordingly, the rotational force of motor 240 transfers to pulsator 260 through first pulsator rotating shaft 282, through first bevel gear 272, through third bevel gear 276 and through second pulsator rotating shaft 284.

First power transferring mechanism 400 includes a first connecting rod 320 having a first end fixedly coupled to second bevel gear 274, includes a first support member 310 for rotatably supporting first connecting rod 320, and includes a first eccentric rotating plate 330 provided on a predetermined position of first connecting rod 320. According to another embodiment of the present invention, first eccentric rotating plate 330 is integrally formed with first connecting rod 320.

Figure 3:
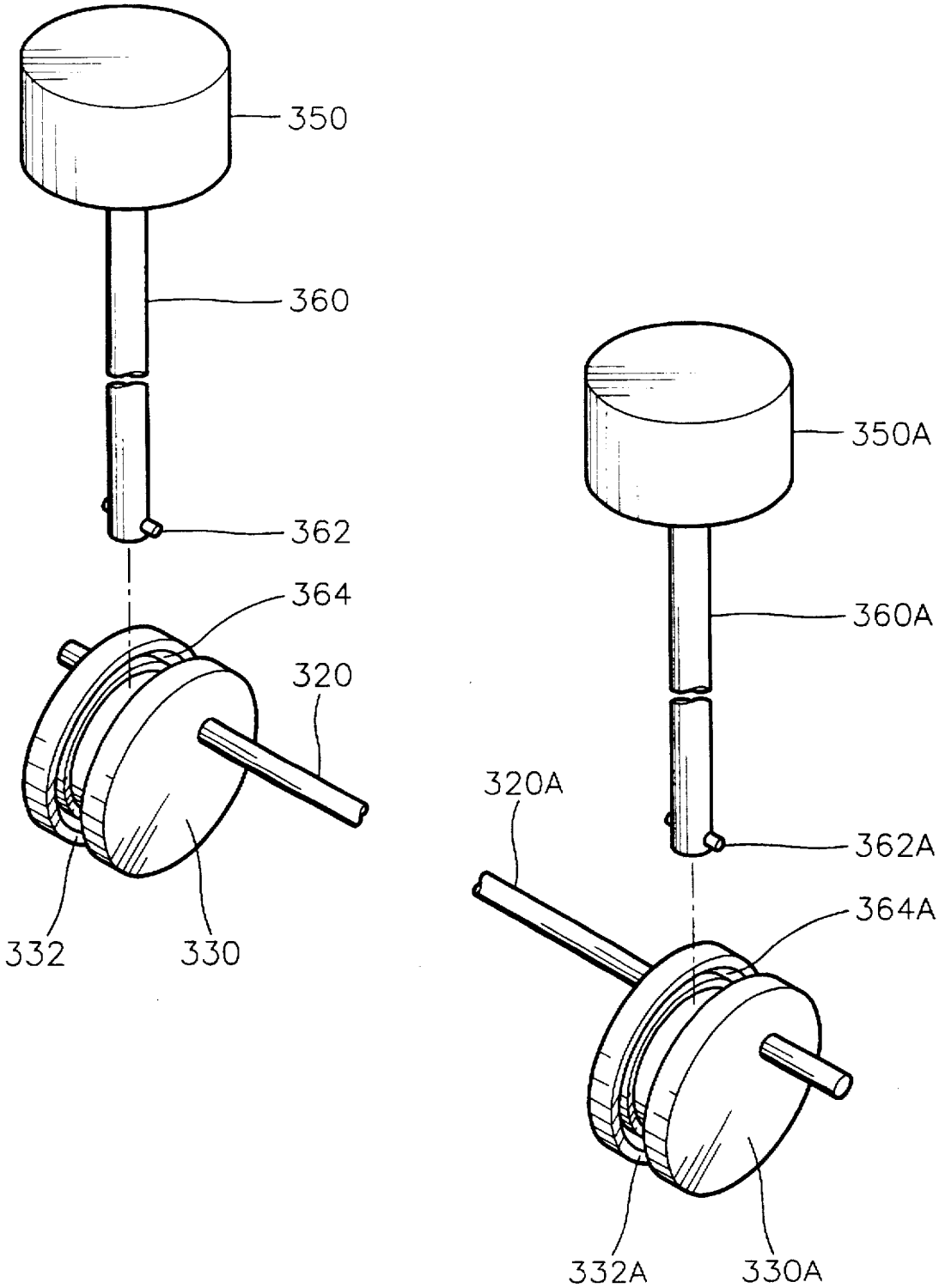
FIG. 3 is an exploded perspective view of piston assemblies and power transferring mechanisms shown in FIG. 2.
Figure 4:
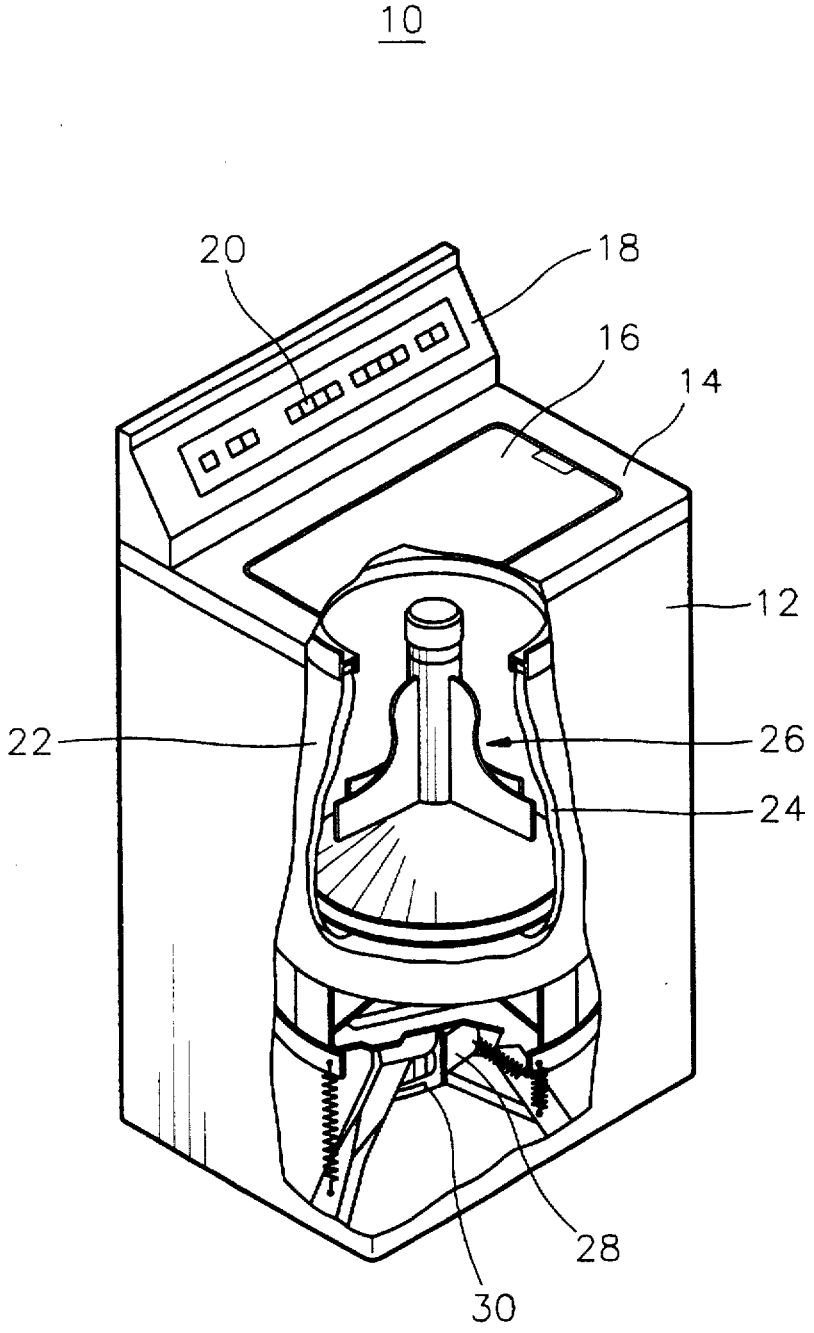
FIG. 4 (PRIOR ART)
FIG. 4 is a sectional view showing a structure of a conventional washing machine.
Figure 5:
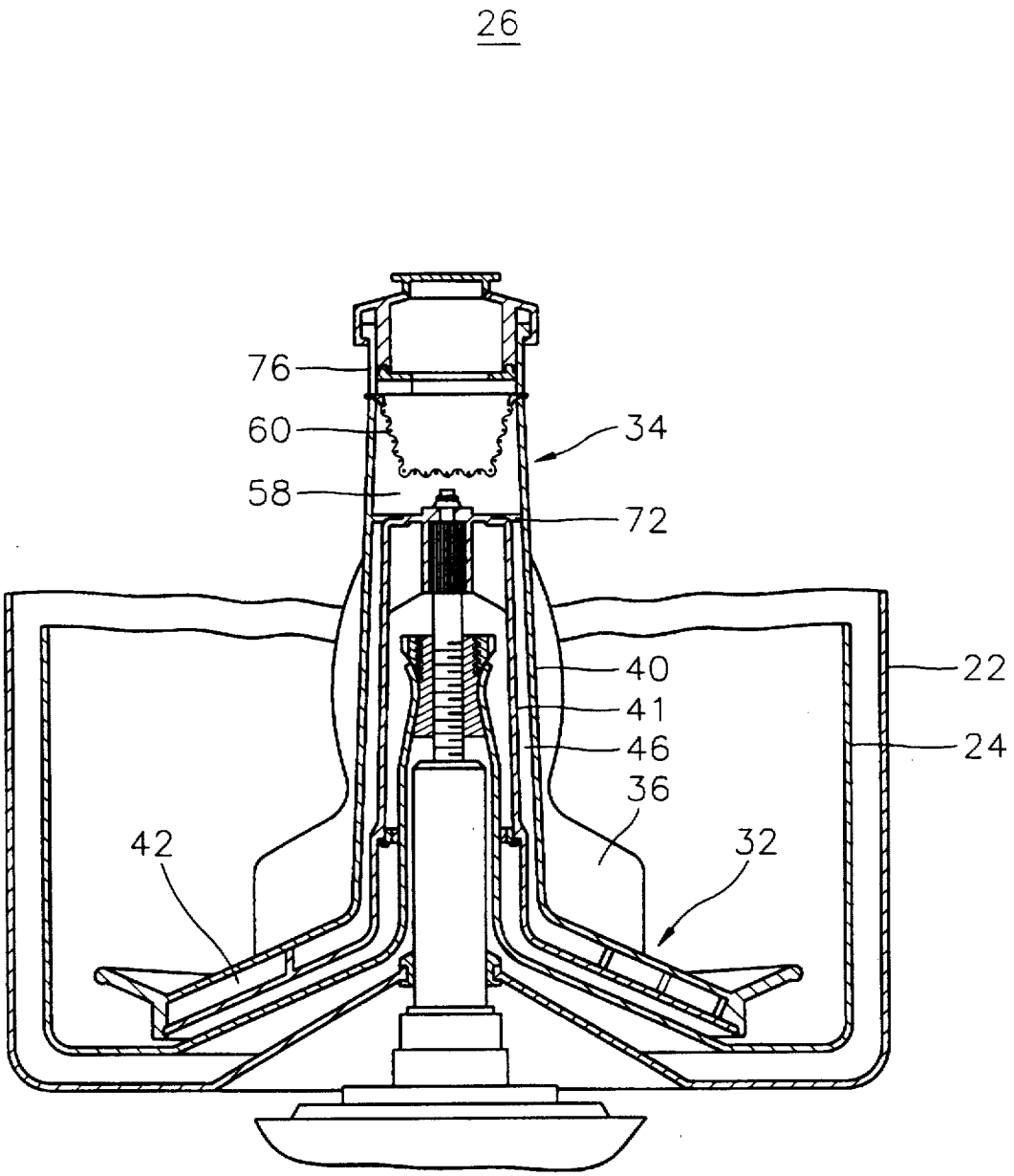
FIG. 5 (PRIOR ART)
FIG. 5 is a sectional view showing an internal structure of an agitator shown in FIG. 4.

A second end of first connecting rod 320 is rotatably inserted into first engagement hole 291 formed at the lower inner wall of spin tub 230. First support member 310 is fixedly coupled to the upper surface of rotating plate 258, and has a first opening 312 into which first connecting rod 320 is rotatably engaged. First eccentric rotating plate 330 is disposed in a position corresponding to the position of first piston assembly 300 and is formed at a circumference thereof with a first annular groove 332 into which first piston assembly 300 is slidably inserted. In addition, as shown in FIG. 3, a pair of first annular slots 364 are respectively formed in side walls of first annular groove 332. The center of first eccentric rotating plate 330 is off-set from the center of first connecting rod 320 by a predetermined distance, thereby permitting first piston assembly 300 to reciprocate within first cylinder 234 while first eccentric rotating plate 330 is being rotated.

Second power transferring mechanism 400A includes a second connecting rod 320A having a first end fixedly coupled to fourth bevel gear 278, includes a second support member 310A for rotatably supporting second connecting rod 320A, and includes a second eccentric rotating plate 330A provided at a predetermined position on second connecting rod 320A. According to another embodiment of the present invention, second eccentric rotating plate 330A is integrally formed with second connecting rod 320A.

A second end of second connecting rod 320A is rotatably inserted into second engagement hole 292 formed at the lower inner wall of spin tub 230. Second support member 310A is fixedly coupled to the upper surface of rotating plate 258, and has a second opening 312A into which second connecting rod 320A is rotatably engaged. Second eccentric rotating plate 330A is disposed in a position corresponding to the position of second piston assembly 300A, and is formed at a circumference thereof with a second annular groove 332A into which second piston assembly 300A is slidably inserted. In addition, as shown in FIG. 3, a pair of second annular slots 364A are respectively formed in side walls of second annular groove 332A. The center of second eccentric rotating plate 330A is off-set from the center of second connecting rod 320A by a predetermined distance, thereby permitting second piston assembly 300A to reciprocate within second cylinder 236 while second eccentric rotating plate 330A is being rotated.

First piston assembly 300 includes a first piston head 350 slidably disposed in first cylinder 234, and includes a first actuating rod 360 integrally formed with first piston head 350. First engagement pin 362, which is slidably inserted into first annular slots 364, is coupled to a lower portion of first actuating rod 360. First piston head 350 has an outer diameter which is substantially identical to an inner diameter of first cylinder 234. A distal end portion of first actuating rod 360 is slidably seated on a bottom wall of first annular groove 332 of first eccentric rotating plate 330. In addition, first actuating rod 360 is movably engaged with a first perforation hole 340 of first guider 287, thereby ensuring a stable reciprocating movement of first piston assembly 300.

Second piston assembly 300A includes a second piston head 350A slidably disposed in second cylinder 236 and includes a second actuating rod 360A integrally formed with second piston head 350A. Second engagement pin 362A, which is slidably inserted into second annular slots 364A, is coupled to a lower portion of second actuating rod 360A. Second piston head 350A has an outer diameter which is substantially identical to an inner diameter of second cylinder 236. A distal end portion of second actuating rod 360A is slidably seated on a bottom wall of second annular groove 332A of second eccentric rotating plate 330A. In addition, second actuating rod 360A is movably engaged with a second perforation hole 340A of second guider 288, thereby ensuring a stable reciprocating movement of second piston assembly 300A.

Washing machine 200 having the construction as described above operates as follows.

Firstly, when a user pushes an operating button installed on a control panel, the washing liquid is introduced from a liquid source into outer tub 220 until a liquid level in outer tub 220 reaches a predetermined level.

Then, when the liquid level in outer tub 220 reaches the predetermined liquid level, a liquid feed control valve blocks a liquid feeding pipe 214, so the supply of the washing liquid stops. At the same time, motor 240 rotates in the forward and reverse directions. The rotational force of motor 240 is transmitted to pulsator 260 by way of transmission 250, by way of first pulsator rotating shaft 282, by way of first bevel gear 272, by way of third bevel gear 276, and by way of second pulsator rotating shaft 284. As a result, pulsator 260 rotates in the forward and reverse directions, thereby washing the articles.

At the same time, the rotational force of motor 240 is also transmitted to both first and second power transferring mechanisms 400 and 400A through second bevel gear 274 and through fourth bevel gear 278, respectively. Accordingly, as shown in FIG. 1 by arrows 410 and 420, first and second connecting rods 320 and 320A rotate in directions opposite to each other.

As first and second connecting rods 320 and 320A rotate, first and second eccentric rotating plates 330 and 330A, which are integrally formed with first and second connecting rods 320 and 320A also rotate, so first and second piston assemblies 300 and 300A slidably inserted into first and second annular grooves 332 and 332A are reciprocated within first and second cylinders 234 and 236, respectively.

By the reciprocating movement of first and second piston assemblies 300 and 300A, the washing liquid filled in first and second cylinders 234 and 236 is pumped towards the upper portion of spin tub 230 through first aperture 237 and through second aperture 239, respectively. The washing liquid which has been pumped towards the upper portion of spin tub 230 collides with the swirl-shaped liquid flow which is generated by pulsator 260, thereby creating a turbulent liquid flow in spin tub 230, and thereby preventing the articles from tangling with each other. In addition, the washing liquid which has been pumped towards the upper portion of spin tub 230 also collides with articles floating in the upper portion of spin tub 230, thereby improving the washing effect at the upper portion of spin tub 230.

While the washing cycle is being executed, circulation pump 170 also operates, so some of the washing liquid that has been introduced into outer tub 220 is discharged from outer tub 220 into circulation pump 170 through discharging tub 172. Upon receiving the washing liquid, circulation pump 170 compresses the washing liquid and circulates the washing liquid through circulation tube 176 into spraying nozzle assembly 100 mounted on the upper portion of outer tub 220. Then, the washing liquid is strongly sprayed into spin tub 230 by spraying nozzle assembly 100, so the washing effect is further improved.

When the washing cycle has finished, the pump motor rotates in the reverse direction. At this time, the first valve disposed between circulation pump 170 and circulation tube 176 is closed, and the second valve disposed between circulation pump 170 and drain tube 174 is opened. Accordingly, the washing liquid filled in outer tub 220 is drained out of washing machine 200 by way of discharging tube 172, by way of circulation pump 170, and by way of drain tube 174.

As described above, the washing machine of the present invention can strongly pump the washing liquid toward the upper portion of the spin tub while the washing cycle is being executed, so a turbulent liquid flow is created in the spin tub and thereby the articles are prevented from tangling with each other.

In addition, the washing liquid which has been pumped towards the upper portion of the spin tub collides with articles floating in the upper portion of the spin tub, thereby improving the washing effect at the upper portion of the spin tub.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A washing machine comprising:

a housing;

an outer tub disposed in the housing so as to receive a washing liquid;

a spin tub accommodated in the outer tub, the spin tub having a plurality of discharging holes at a side wall thereof, the spin tub being divided into an upper chamber and a lower chamber by a compartment, the spin tub being formed at an inner wall thereof with first and second cylinders which are positioned in opposition to each other;

a motor for generating a rotational force;

a pulsator mounted on an upper surface of the compartment;

a pulsator driving section for driving the pulsator by receiving the rotational force from the motor;

a first means for pumping the washing liquid towards an upper portion of the spin tub, the first means being disposed within the first cylinder;

a second means for pumping the washing liquid towards the upper portion of the spin tub, the second means being disposed within the second cylinder;

a third means for transferring the rotational force of the motor to the first means; and a fourth means for transferring the rotational force of the motor to the second means.

2. The washing machine as claimed in claim 1, wherein the motor includes a reversible motor.

3. The washing machine as claimed in claim 1, wherein the first and second cylinders are respectively formed at upper walls thereof with first and second apertures, so that the washing liquid is pumped towards the upper portion of the spin tub.

4. The washing machine as claimed in claim 1, wherein the pulsator driving section includes a transmission connected to the motor, a first pulsator rotating shaft mounted on an upper portion of the transmission, a bevel gear assembly, and a second pulsator rotating shaft, the bevel gear assembly having first, second, third, and fourth bevel gears, the first bevel gear being engaged with both second and fourth bevel gears, the second bevel gear being engaged with both first and third bevel gears, the third bevel gear being engaged with both second and fourth bevel gears, and the fourth bevel gear being engaged with both third and first bevel gears, the first pulsator rotating shaft being fixedly coupled to the first bevel gear, a first end of the second pulsator driving shaft being fixedly coupled to the pulsator, and a second end of the second pulsator driving shaft being fixedly coupled to the third bevel gear.

5. The washing machine as claimed in claim 4, wherein the first means includes a first piston assembly having a first piston head slidably disposed in the first cylinder, having a first actuating rod integrally formed with the first piston head and having a first engagement pin coupled to a lower portion of the first actuating rod, and the second means includes a second piston assembly having a second piston head slidably disposed in the second cylinder, having a second actuating rod integrally formed with the second piston head, and having a second engagement pin coupled to a lower portion of the second actuating rod.

6. The washing machine as claimed in claim 5, wherein the first and second cylinders are respectively provided at undersides thereof with first and second guiders for respectively guiding a reciprocating movement of the first and second piston assemblies.

7. The washing machine as claimed in claim 6, wherein the first and second guiders are integrally formed at the undersides of first and second cylinders, respectively.

8. The washing machine as claimed in claim 6, wherein the third means includes a first connecting rod having a first end fixedly coupled to the second bevel gear, includes a first support member for rotatably supporting the first connecting rod, and includes a first eccentric rotating plate provided on a first predetermined position of the first connecting rod.

9. The washing machine as claimed in claim 8, wherein the first eccentric rotating plate is integrally formed with the first connecting rod, and a center of the first eccentric rotating plate is off-set from a center of the first connecting rod by a predetermined distance.

10. The washing machine as claimed in claim 8, wherein the fourth means includes a second connecting rod having a first end fixedly coupled to the fourth bevel gear, includes a second support member for rotatably supporting the second connecting rod, and includes a second eccentric rotating plate provided on a second predetermined position of the second connecting rod.

11. The washing machine as claimed in claim 10, wherein the second eccentric rotating plate is integrally formed with the second connecting rod, and a center of the second eccentric rotating plate is off-set from a center of the second connecting rod by a predetermined distance.

12. The washing machine as claimed in claim 10, wherein a second end of the first connecting rod is rotatably inserted into a first engagement hole formed at a lower inner wall of the spin tub, and a second end of the second connecting rod is rotatably inserted into a second engagement hole which is formed in opposition to the first engagement hole.

13. The washing machine as claimed in claim 10, wherein the first eccentric rotating plate is formed at a circumference thereof with an annular groove into which a terminal end of the first actuating rod is slidably inserted, the annular groove being formed at side walls thereof with a pair of annular slots into which the first engagement pin is slidably inserted.

14. The washing machine as claimed in claim 10, wherein the second eccentric rotating plate is formed at a circumference thereof with an annular groove into which a terminal end of the second actuating rod is slidably inserted, the annular groove being formed at side walls thereof with a pair of annular slots into which the second engagement pin is slidably inserted.

15. A washing machine comprising:

a housing;

an outer tub disposed in the housing so as to receive a washing liquid;

a spin tub accommodated in the outer tub, the spin tub having a plurality of discharging holes at a side wall thereof, the spin tub being divided into an upper chamber and a lower chamber by a compartment, the spin tub being formed at an inner wall thereof with first and second cylinders which are positioned in opposition to each other, the first and second cylinders being respectively formed at upper walls thereof with first and second apertures;

a reversible motor for generating a rotational force;

a pulsator mounted on an upper surface of the compartment;

a pulsator driving section for driving the pulsator by receiving the rotational force from the motor, the pulsator driving section including a transmission connected to the motor, a first pulsator rotating shaft mounted on an upper portion of the transmission, a bevel gear assembly, and a second pulsator rotating shaft, the bevel gear assembly having first, second, third, and fourth bevel gears, the first bevel gear being engaged with both second and fourth bevel gears, the second bevel gear being engaged with both first and third bevel gears, the third bevel gear being engaged with both second and fourth bevel gears, and the fourth bevel gear being engaged with both third and first bevel gears, the first pulsator rotating shaft being fixedly coupled to the first bevel gear, a first end of the second pulsator driving shaft being fixedly coupled to the pulsator, and a second end of the second pulsator driving shaft being fixedly coupled to the third bevel gear;

a first piston assembly having a first piston head slidably disposed in the first cylinder, a first actuating rod integrally formed with the first piston head, and a first engagement pin coupled to a lower portion of the first actuating rod;

a second piston assembly having a second piston head slidably disposed in the second cylinder, a second actuating rod integrally formed with the second piston head, and a second engagement pin coupled to a lower portion of the second actuating rod;

first and second guiders for respectively guiding a reciprocating movement of the first and second piston assemblies, the first and second guiders being respectively provided at undersides of the first and second cylinders;

a first power transferring mechanism including a first connecting rod having a first end fixedly coupled to the second bevel gear and a second end rotatably inserted into a first engagement hole formed at a lower inner wall of the spin tub, including a first support member for rotatably supporting the first connecting rod, and including a first eccentric rotating plate integrally formed on a first predetermined position of the first connecting rod, a center of the first eccentric rotating plate being off-set from a center of the first connecting rod by a first predetermined distance, the first eccentric rotating plate being formed at a circumference thereof with a first annular groove into which a terminal end of the actuating rod is slidably inserted, the annular groove being formed at side walls thereof with a pair of first annular slots into which the first engagement pin is slidably inserted; and a second power transferring mechanism including a second connecting rod having a first end fixedly coupled to the fourth bevel gear and a second end rotatably inserted into a second engagement hole which is formed in opposition to the first engagement hole, including a second support member for rotatably supporting the second connecting rod, and including a second eccentric rotating plate integrally formed on a second predetermined position of the second connecting rod, a center of the second eccentric rotating plate being off-set from a center of the second connecting rod by a second predetermined distance, the second eccentric rotating plate being formed at a circumference thereof with a second annular groove into which a terminal end of the second actuating rod is slidably inserted, the annular groove being formed at side walls thereof with a pair of annular slots into which the second engagement pin is slidably inserted.

* * * * *